United States Patent [19]

High

[11] 4,009,627

[45] Mar. 1, 1977

[54] DEVICE FOR DISPENSING PORTIONS OF A CHAIN

[75] Inventor: Cliff High, Tacoma, Wash.

[73] Assignee: Morley Brotman, Tacoma, Wash.

[22] Filed: Nov. 3, 1975

[21] Appl. No.: 628,399

[52] U.S. Cl. ..... 83/205; 83/267; 83/269; 83/282; 221/71; 221/30

[51] Int. Cl.[2] ..... B26D 5/40

[58] Field of Search ..... 83/205, 269, 267, 282, 83/42; 221/30, 71

[56] References Cited

UNITED STATES PATENTS

| | | | |
|---|---|---|---|
| 661,130 | 11/1900 | Pape | 221/71 X |
| 724,187 | 3/1904 | Joyce | 221/30 X |
| 1,793,165 | 2/1931 | Eckmann | 221/71 X |
| 3,838,619 | 10/1974 | Brotman et al. | 83/205 |

*Primary Examiner*—Willie G. Abercrombie
*Attorney, Agent, or Firm*—Christensen, O'Connor, Garrison & Havelka

[57] ABSTRACT

The device is particularly adapted to dispense portions of a chain having relatively diametrically enlarged segments therein, such as master links, which are disposed at substantially regularly spaced intervals along the length of the chain, although the intervals may not and in fact need not be uniformly spaced. According to the apparatus, the chain is supported so that it is movable relatively lengthwise thereof through the opening in a collar which is capable of being opened and closed about the chain, and the opening of which has a diameter of less than that of the relatively enlarged segments of the chain in the closed condition of the collar. When the collar is open, the chain is advanced lengthwise in the direction of the collar to the extent that a portion of the chain including one relatively enlarged segment therein, is fed through the opening in the collar and assumes a position on the opposite side thereof. Then the collar is closed, the chain is tensioned against the collar, and the chain is severed at a point on the opposite side of the collar to dispense the portion.

14 Claims, 4 Drawing Figures

Fig. 1
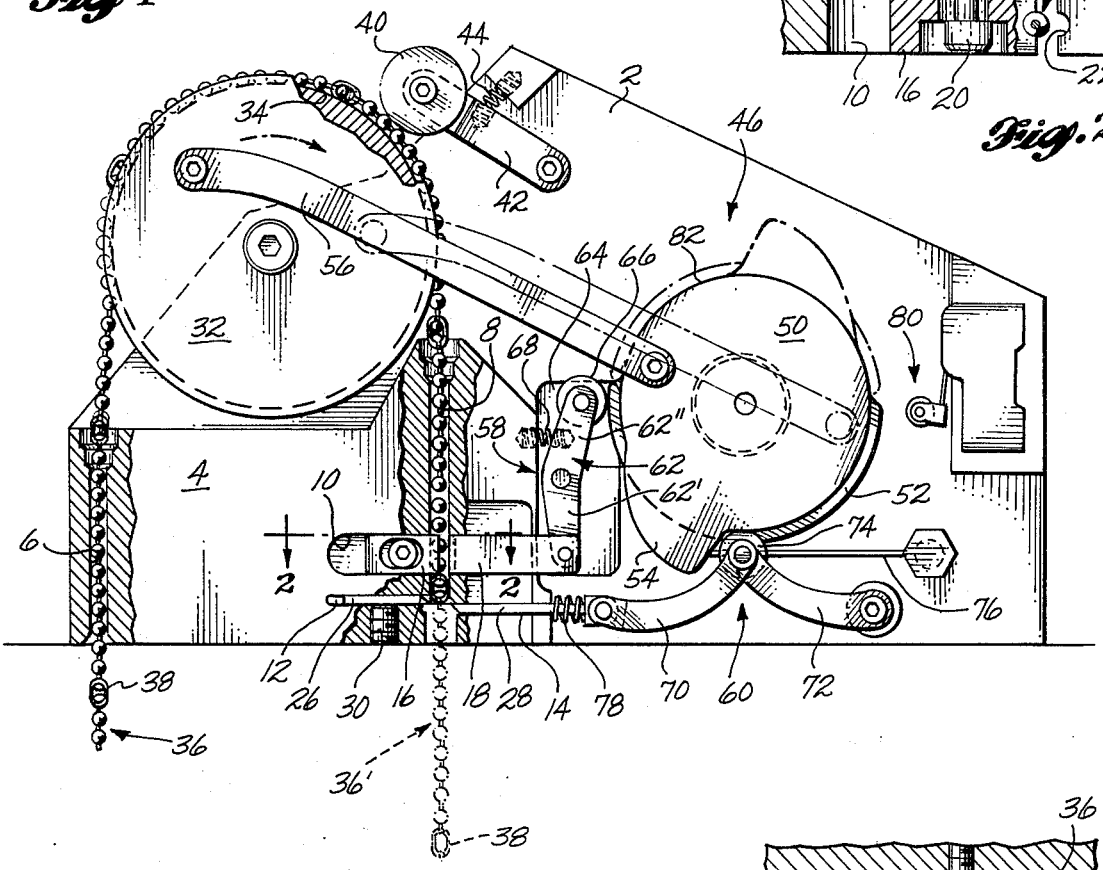
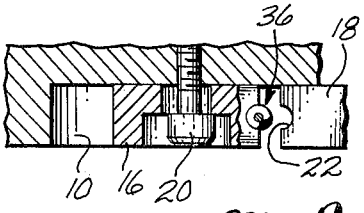
Fig. 2
Fig. 3
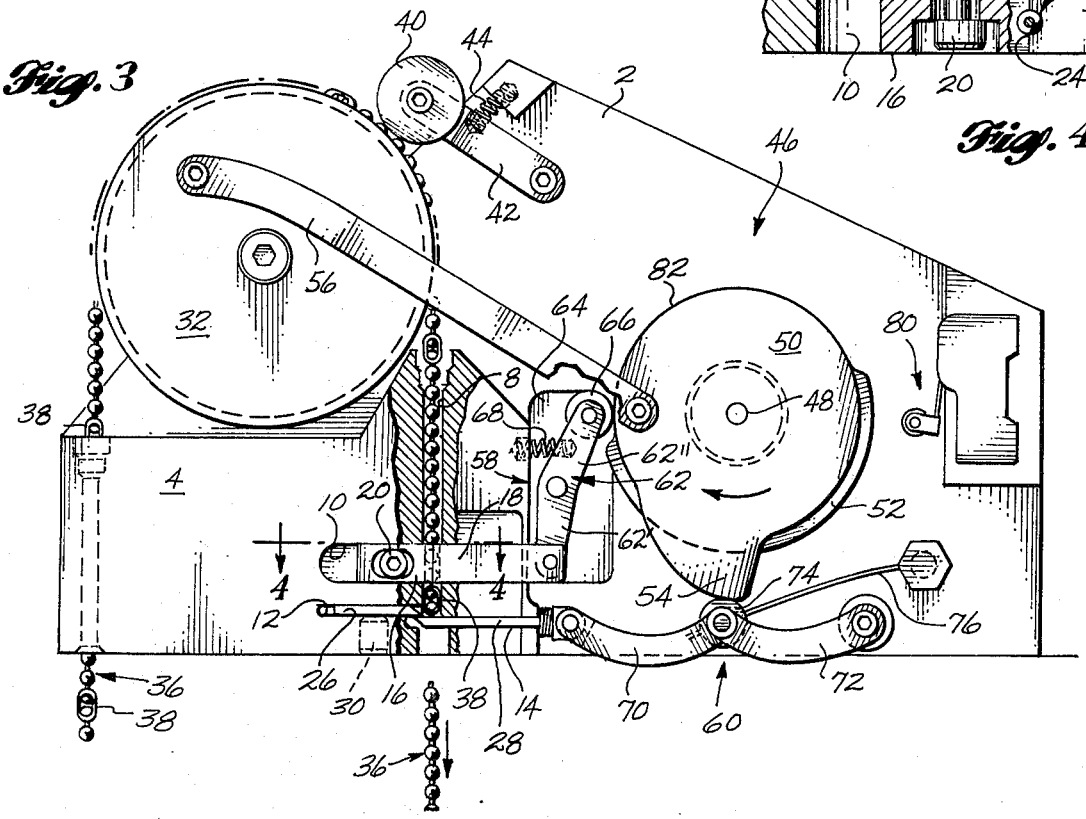
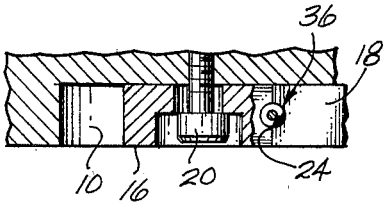
Fig. 4

DEVICE FOR DISPENSING PORTIONS OF A CHAIN

THE INVENTION IN GENERAL

The invention relates to a device for dispensing portions of a chain, and in particular, portions of a chain having relatively diametrically enlarged segments at substantially reqularly spaced intervals along the length thereof. An example of such a chain is the wholesale supplier's chain from which conventional key chains are dispensed. Each key chain comprises a series of spaced ball-like links which are pivotally interconnected with one another by a corresponding series of pinlike links that are interposed in the spaces between the respective pairs of ball-like links. Each also comprises an ovalshaped master link which is disposed at one end of the key chain and relatively diametrically enlarged to recieve the ball-like link at the opposite end thereof, when the chain is formed in a closed loop. When the key chains are joined in gross, however, such as in a wholesaler's dispensing chain, the individual key chains are serially interconnected to one another at the master links. Therefore, the dispensing process and the dispensing device, must operate to sever the endmost key chain from the dispensing chain, at a point immediately to one side or the other of a master link, so that the severed chain includes a master link and whatever number of intermediate ball and pin-links occurs between each pair of master links in the dispensing chain. This is not easily accomplished, however, in a machine-fed device, since the number of intermediate links tends to vary from one key chain to the next, with the result that the respective key chains do not have a uniform length from one key chain to the next in the dispensing chain. Therefore, the process and device must also accommodate to the variable lengths of the key chains, if each key chain is to be severed from the dispensing chain, at a point immediately to one side or the other of a master link.

One advantage of the present invention is that the device are capable of dispensing key chains or the like, from a dispensing chain in which the individual key chains are of nonuniform length, due for example, to the variable number of intermediate links between the relatively diametrically enlarged master links of the chain. The chain is supported so that it is movable relatively lengthwise thereof through the opening in a collar which is capable of being opened and closed about the chain, and the opening of which has a diameter of less than that of the relatively enlarged master links of the chain in the closed condition of the collar. When the collar is open, the chain is advanced lengthwise in the direction of the collar to the extent that a portion of the chain including one master link therein, is fed through the opening in the collar and assumes a position on the opposite side thereof. Then the collar is closed, the chain is tensioned against the collar, and the chain is severed at a point on the opposite side thereof to dispense the portion.

The chain may be supported, advanced, and tensioned by a single chain engaging means; and the chain engaging means, the means for opening and closing the collar, and the means for severing the chain, may all be driven through a common actuating means. Also, the actuating means may be rotary driven.

For example, one of the presently preferred devices for practicing the method comprises a pair of collar forming jaws and means for supporting the dispensing chain so that it is movable relatively lengthwise thereof through the opening in the collar. The jaws are relatively reciprocably mounted to enable the collar to be opened and closed about the chain, and the opening in the collar has a diameter of less than that of the master links of the chain in the closed condition of the collar. A chain engaging member is relatively reciprocably mounted on one side of the collar, and is operable to advance the chain lengthwise in the direction of the collar when said member reciprocates in one direction thereof. Alternately, the chain engaging member is operable to undergo slippage lengthwise of the chain, in the direction away from the collar, when said member is reciprocated in in the other direction thereof. In addition, there are means operable to sever the chain at a point on the opposite side of the collar; and means interconnected with the jaws, the chain engaging member, and the chain severing means, to actuate the same in two stages. In the first stage, the actuating means is operable to open the collar and reciprocate the chain engaging member in the one direction thereof, to the extent that a portion of the chain including one master link therein, is fed through the opening in the collar and assumes a position on the other side thereof. In the second stage, the actuating means is operable to close the collar and actuate the chain severing means, while reciprocating the chain engaging member in the other direction thereof, to tension the chain against the collar.

This device lends itself to the actuating means being driven by a rotary drive means, which in turn may be hand driven, but is preferably motor driven. For example, the actuating means may include a pair of reciprocably mounted cam followers, a first cam follower of which is connected with the jaws and yieldably biased to open the collar, and the second cam follower of which is connected with the chain severing means and yieldably biased to deactuate the same; the rotary drive means may have a pair of cams thereon, a first cam of which is operable to reciprocate the first cam follower against the bias thereon and thereby close the collar, and the second cam of which is operable to reciprocate the second cam follower against the bias thereon and thereby actuate the chain severing means; and there may be a drive connection between the drive means and the chain engaging member, which is operable to convert the rotation of the drive means into the aforesaid reciprocable motion on the part of the chain engaging member.

The foregoing device also lends itself to the chain engaging member serving as the chain supporting and tensioning means, and the drive connection between the rotary drive means and said member serving to meter the appropriate amount of chain through the opening in the collar when the collar is open. For example, the chain engaging member may take the form of a first rotatably mounted wheel which is adapted to engage and support the chain when it is passed thereabout, and the drive connection may take the form of a rod which is eccentrically connected with and between the first wheel and the drive means. Preferably, the first wheel has a circumferential groove therein for the chain, and there is an idler roller thereadjacent which is yieldably biased to engage the chain at the circumferential periphery of the wheel, and interengage the chain and the wheel for the first stage of the operation of the actuating means, while allowing the wheel to undergo slippage in relation to the chain in the second stage of the operation of the actuating means.

In the presently preferred embodiments of the invention, the drive means includes a second rotatably mounted wheel which has the cams on the perimeter thereof, and the rod is interconnected between the first and second wheels. One of the jaws is fixed and the other is reciprocable in relation to the one jaw. The connection between the first cam follower and the jaws includes a pair of rotatably mounted but rigidly interconnected levers, one of which levers has a cam roller thereon and is yieldably biased to rotate in the direction of the second wheel, and the other of which is pivotally interconnected with the other jaw to reciprocate the same when the first cam on the second wheel engages the cam roller. The chain severing means includes a pair of blades, one of which is fixed and the other of which is reciprocable in relation to the one blade. The connection between the second cam follower and the chain severing means includes a pair of conjointly rotatably mounted but pivotally interconnected toggle links having a second cam roller at the pivotal connection therebetween, one of which links is yieldably biased to rotate about the fulcrum in the direction of the second wheel, and the other of which links is pivotally interconnected with the other blade to reciprocate the same when the second cam on the second wheel engages the second cam roller.

In these embodiments, moreover, the drive means is driven by an electrical motor, and the power for the same is de-energized by a switch. The second wheel has a cam thereon which is engageable with the switch to de-energize the power between the first and second stages of the actuating means. In fact, one of the first and second cams may operate as the switch engageable cam.

Furthermore, in these embodiments, the jaws form an annular collar and the collar fully encloses the chain. The collar may also engage the chain at points between the master links thereof, and in fact, the actuating means may be operable to lightly clamp the collar about the chain at said points, when the first wheel has tensioned the chain against the collar.

BRIEF DESCRIPTION OF THE DRAWING

These features will be better understood by reference to the accompanying drawing which illustrates one of the presently preferred embodiments of the drive.

In the drawing,

FIG. 1 is a part cross sectional, side elevational view of the device in the first stage of the operation of the actuating means;

FIG. 2 is a part cross sectional view of the device along the line 2—2 in FIG. 1;

FIG. 3 is another part cross sectional, side elevational view of the device in the second stage of the operation of the actuating means; and FIG. 4 is a part cross sectional view of the device along the line 4—4 in FIG. 3.

DESCRIPTION OF THE PREFERRED EMBODIMENT

Referring to the drawing, it will be seen that the device comprises a mounting panel 2 and an associated mounting block 4 at the left hand end thereof. The mounting panel 2 is part of a larger housing, the balance of which is omitted from the drawing, however, for ease of illustration. The mounting block 4 has a pair of vertical bores 6 and 8 therethrough, as well as three horizontally disposed grooves 10, 12 and 14 in the proximate face thereof. The uppermost groove 10 opens at the right hand end of the block 4 and has a pair of collar forming jaws 16 and 18 received therein, the left hand jaw 16 of which is slotted to accommodate a set screw for fixing the position of the same, and the right hand jaw 18 of which is slidably engaged in the groove 10 to enable it to be reciprocated in relation to the fixed jaw 16. The jaws have part cylindrical vertical grooves 22 (FIGS. 2 and 4) in the opposing ends thereof, and together the grooves 22 form a full cylindrical opening 24 (FIG. 4) therebetween, when the ends of the jaws are abutted together in the manner of FIG. 4. The intermediate and lowermost grooves 12 and 14 are staggered in height, but co-planer with one another to accommodate a pair of cooperating blades 26 and 28, the left hand blade 26 of which is fixed in the intermediate groove 12 by a set screw, and the right hand blade 28 of which is slidably engaged in the lowermost groove 14 to be reciprocated in relation to the fixed blade 26. The bores 6 and 8 are counterbored at the top, and are spaced apart in the left hand and right hand end portions of the block 4, respectively, the right hand bore 8 being coaxial with the opening 24 of the collar in the condition of FIG. 4. The right hand bore 8 is also somewhat enlarged at the bottom and dadoed at the left hand side thereof to accommodate the leading edge of the reciprocable blade 29.

A circumferentially grooved wheel 32 is rotatably mounted above the mounting block 4 with the groove 34 thereof in the plane of the bores 6 and 8. In addition, the wheel 32 is sized in diameter to correspond substantially to the distance between the bores 6 and 8, so that a key-chain dispensing chain 36 can be passed about the wheel and supported in the groove 34 thereof, with the respective ends of the chain slidably engaged in the bores 6 and 8, to be guided by the same during the rotation of the wheel. The dispensing chain 36 comprises serially interconnected key-chain portions 36', with relatively diametrically enlarged master links 38 at substantially regularly spaced intervals along the length thereof. The chain extends upwardly into the left hand bore 6 from a free-wheeling supply roll therebelow (not shown) and is interengaged between the wheel 32 and an idler roll 40 thereabove. The idler roll 40 is rotatably mounted at the end of a pivotally mounted lever 42 which is yieldably biased by a coiled spring 44 in the direction of the groove 34 on the wheel. The bias is such that the wheel 32 is operable to advance the chain 36 lengthwise thereof, when the wheel is rotated in the clockwise direction thereof, yet when the wheel is rotated in the opposite direction, it can undergo slippage in relation to the chain, assuming that the chain is temporarily retained in its advanced position.

This latter effect is achieved by reciprocating the jaw 18 to close the collar 24 about the chain after the chain has been advanced by the wheel 32 from the full line condition of FIG. 1 to the phantom-lined condition thereof; and while the chain is retained by the collar, the blade 28 is operated to sever the chain at a point immediately below the adjacent master link 38. The jaw, wheel, and blade are operated in turn by an actuating means 46 on the right hand side of the wheel 32, which is driven in turn by an electric motor (not shown) in connection with a shaft 48 at the center of the actuating means. The actuating means 46 comprises a second wheel 50 which is rotatably mounted on the shaft 48 so as to be substantially coplanar with the chain supported wheel 32. The second wheel has a pair of juxtaposed cams 52 and 54 on the circumferential periphery thereof, and one of the cams 52 is substantially semi-circular in configuration while the other 54 is lobe-like in configuration. The semi-circular cam 52 operates to reciprocate the reciprocable jaw 18, and the lobe-like cam 54 operates to reciprocate the reciprocable blade 28. In addition, a rod 56 is eccentrically interconnected with and between the two wheels 32 and 50, to enable the cam carrying wheel 50 to reciprocate the chain supporting wheel 32 as the shaft 48 is rotated in the clockwise direction thereof.

The cams 52 and 54 operate the jaw and blade in appropriate sequence, and in harmony with the chain supporting wheel 32, through a pair of intermediate servo mechanisms 58 and 60, one of which 58 is interposed between the jaw 18 and the semicircular cam 52, and the other of which 60 is interposed between the blade 28 and the lobe-like cam 54. The mechanism 58 comprises a bellcrank lever 62 which is pivotally mounted on a bracket 64 extending from the right hand end of the block 4. The lower arm 62' of the lever 62 is pivotally interconnected with the jaw 18 to reciprocate the same, and the upper arm 62'' has a cam follower roll 66 at the upper end thereof, and is urged to rotate in the direction of the wheel 50 by a coiled spring 68 interposed between the block 4 and the arm 62''. The mechanism 60 comprises a pair of curved toggle links 70 and 72 which have a cam follower roll 74 at the pivotal connection therebetween. The right hand link 72 is rotatably mounted on the panel 2 and is urged to rotate in the direction of the wheel 50 by a leaf spring 76 which is connected to the pivot of the roll 74. The left hand link 70 is pivotally connected to the blade 28, and in addition to the bias of the spring 76, there is also a coiled spring 78 caged about the blade 28 between the block 4 and the adjacent end of the left hand link 70.

Although the actuating means 46 may be hand driven, where it is motor driven as indicated, preferably a micro switch 80 is positioned at the right hand side of the wheel 50, to be intercepted by the lobe-like cam 54 on the same. The switch 80 operates to de-energize the electrical power to the motor, and does so when the actuating means 46 has undergone the first stage of its operation and is commencing the second stage, as shall be explained.

The at-rest condition of the device is seen in FIG. 1. When the motor is activated by the user, it rotates the cam carrying wheel 50 in the clockwise direction thereof, and the connecting rod 56 in turn rotates the chain supporting wheel 32 in the same direction to meter out a full key chain length 36' below the collar 24. Meanwhile, the reciprocable jaw 18 remains retracted under the counter force of the cam 52 against the bias of the spring 68; and the blade 28 remains retracted under the combined bias of the springs 76 and 78. However, after the wheel has rotated sufficient distance to meter out a full key chain length, the roll 66 leaves the semi-circular cam 52 and descends to the uncamed peripheral surface 82 of the wheel 50 at the counter clockwise end of the cam 52. As a consequence, the bellcrank lever 62 rotates clockwise under the bias of the spring 68, thereby closing the collar 24 about the chain at a point immediately above the secondmost master link 38 in the chain (FIG. 1). Meanwhile, the cam 54 continues to rotate in the clockwise direction of the wheel 50, and engages first the switch 80 and then the roll 74. When the cam engages the switch, the switch de-energizes the motor, thus discontinuing the drive to the wheel 50. However, the momentum of the wheel continues to rotate the cam 54 in the direction of the roll 74 and as the sloped clockwise face of the cam progressively displaces the roll against the bias of the springs 76 and 78, the spring 78 offers sufficient counterforce to assure that when it is suddenly overcome by the toggle action of the links, the effect is to "snap" the blade 28 across the chain in a clean shear stroke. At the same time, the roll descends the more sharply sloped backside of the cam, and the blade is retracted from the bore 8 under the bias of the springs 76 and 78. In addition, the cam 54 soon displaces the roll 66 to retract the jaw 18 and open the collar, thus returning the device to the at-rest condition of FIG. 1.

What is claimed is:

1. A device for dispensing portions of a chain having relatively diametrically enlarged segments at substantially regularly spaced intervals along the length thereof, comprising a pair of collar forming jaws and means for supporting the chain so that it is movable relatively lengthwise thereof through the opening in the collar, the jaws being relatively reciprocably mounted to enable the collar to be opened and closed about the chain, and the opening in the collar having a diameter of less than that of the relatively enlarged segments of the chain in the closed condition of the collar; a chain engaging member relatively reciprocably mounted on one side of the collar, and operable to advance the chain lengthwise in the direction of the collar when said member reciprocates in one direction thereof, and alternately, to undergo slippage lengthwise of the chain, in the direction away from the collar, when said member is reciprocated in the other direction; means operable to sever the chain at a point on the opposite side of the collar; and means interconnected with the jaws, the chain engaging member, and the chain severing means, to actuate the same in two stages, in the first stage of which the actuating means is operable to open the collar and reciprocate the chain engaging member in the one direction thereof, to the extent that a portion of the chain including one segment therein, is fed through the opening in the collar and assumes a position on the other side thereof, and in the second stage of which, the actuating means is operable to close the collar and actuate the chain severing means, while reciprocating the chain engaging member in the other direction thereof, to tension the chain against the collar.

2. The device according to claim 1 wherein the chain engaging member takes the form of a rotatably mounted wheel which is adapted to engage and support the chain when it is passed thereabout.

3. The device according to claim 2 wherein the actuating means is driven by a rotary drive means, and there is a drive connection between the drive means and the wheel, which is operable to convert the rotation of the drive means into the aforesaid reciprocable motion on the part of the wheel.

4. The device according to claim 1 wherein the actuating means is driven by a rotary drive means and includes a pair of reciprocably mounted cam followers, a first cam follower of which is connected with the jaws and yieldably biased to open the collar, and the second cam follower of which is connected with the chain severing means and yieldably biased to deactuate the same, said rotary drive means having a pair of cams thereon, a first cam of which is operable to reciprocate the first cam follower against the bias thereon and thereby close the collar, and the second cam of which is operable to reciprocate the second cam follower against the bias thereon and thereby actuate the chain severing means, and there being a drive connection between the drive means and the chain engaging member, which is operable to convert the rotation of the drive means into the aforesaid reciprocable motion on the part of the chain engaging member.

5. The device according to claim 4 wherein the chain engaging member takes the form of a first rotatably mounted wheel which is adapted to engage and support the chain when it is passed thereabout, and the drive connection takes the form of a rod which is eccentrically connected with and between the first wheel and the drive means.

6. The device according to claim 5 wherein the first wheel has a circumferential groove therein for the chain, and there is an idler roller thereadjacent which is yieldably biased to engage the chain at the circumferential periphery of the wheel, and interengage the chain and the wheel for the first stage of the operation of the actuating means, while allowing the wheel to undergo slippage in relation to the chain in the second stage of the operation of the actuating means.

7. The device according to claim 5 wherein the drive means includes a second rotatably mounted wheel which has the cams on the perimeter thereof, and the rod is interconnected between the first and second wheels.

8. The device according to claim 7 wherein one of the jaws is fixed and the other is reciprocable in relation to the one jaw, the connection between the first cam follower and the jaws includes a pair of rotatably mounted but rigidly interconnected levers, one of which levers has a cam roller thereon and is yieldably biased to rotate in the direction of the second wheel, and the other of which is pivotally interconnected with the other jaw to reciprocate the same when the first cam on the second wheel engages the cam roller.

9. The device according to claim 7 wherein the chain severing means includes a pair of blades, one of which is fixed and the other of which is reciprocable in relation to the one blade, the connection between the second cam follower and the chain severing means includes a pair of conjointly rotatably mounted but pivotally interconnected toggle links having a second cam roller at the pivotal connection therebetween, one of which links is yieldably biased to rotate about the fulcrum thereof in the direction of the second wheel, and the other of which links is pivotally interconnected with the other blade to reciprocate the same when the second cam on the second wheel engages the second cam roller.

10. The device according to claim 7 wherein the drive means is driven by an electrical motor and the power for the same is de-energized by a switch, and wherein the second wheel has a cam thereon which is engagable with the switch to de-energize the power between the first and second stages of the operation of the actuating means.

11. The device according to claim 10 wherein one of the first and second cams operates as the switch engageable cams.

12. The device according to claim 1 wherein the jaws form an annular collar and the collar fully encloses the chain.

13. The device according to claim 1 wherein the collar is engageable with the chain at points between the relatively enlarged segments thereof.

14. The device according to claim 13 wherein the actuating means is operable to lightly clamp the collar about the chain at said points, when the chain engaging member has tensioned the chain against the collar.

* * * * *

UNITED STATES PATENT OFFICE

CERTIFICATE OF CORRECTION

Patent No. 4,009,627 Dated March 1, 1977

Inventor(s) Cliff High

It is certified that error appears in the above-identified patent and that said Letters Patent are hereby corrected as shown below:

Column 1, line 15, "pinlike" to read -- pin-like --.

Column 1, line 42, delete "are" and insert therefor -- is --.

Column 2, line 15, delete "in in" and insert therefor -- in --.

Column 5, line 63, delete "uncamed" and insert therefor -- uncammed --.

Column 8, line 29, delete "cams." and insert therefor -- cam. --.

Signed and Sealed this ninth Day of August 1977

[SEAL]

Attest:

RUTH C. MASON
*Attesting Officer*

C. MARSHALL DANN
*Commissioner of Patents and Trademarks*